US005979073A

United States Patent [19]

Fuls et al.

[11] Patent Number: 5,979,073

[45] Date of Patent: Nov. 9, 1999

[54] METHOD OF DRYING A POROUS BODY

[75] Inventors: Paul F Fuls, Pretoria, South Africa; Johann D Le Roux, Sharon, Mass.

[73] Assignee: Implico B.V., Amsterdam, Netherlands

[21] Appl. No.: 08/983,079

[22] PCT Filed: May 20, 1997

[86] PCT No.: PCT/NL97/00283

§ 371 Date: Apr. 6, 1998

§ 102(e) Date: Apr. 6, 1998

[87] PCT Pub. No.: WO97/44626

PCT Pub. Date: Nov. 27, 1997

[30] Foreign Application Priority Data

May 17, 1996 [ZA] South Africa ..... 96/3961

[51] Int. Cl.[6] ..... F26B 3/34

[52] U.S. Cl. ..... 34/259

[58] Field of Search ..... 34/245, 247, 255, 34/256, 259, 265; 219/633, 634, 635, 693, 695, 722, 750

[56] References Cited

U.S. PATENT DOCUMENTS

| | | | |
|---|---|---|---|
| 5,237,755 | 8/1993 | Lowe | 34/265 |
| 5,306,675 | 4/1994 | Wu et al. | 34/259 X |
| 5,335,425 | 8/1994 | Tomizawa et al. | 34/265 |
| 5,388,345 | 2/1995 | Brundage et al. | 34/256 |

FOREIGN PATENT DOCUMENTS

| | | | |
|---|---|---|---|
| 0500252 A1 | 8/1992 | European Pat. Off. . | |
| 0500252 B1 | 8/1992 | European Pat. Off. . | |
| 2180301 | 11/1973 | France . | |
| 2132745 | 7/1984 | United Kingdom . | |
| WO 93/11919 | 6/1993 | WIPO | F26B 3/34 |

*Primary Examiner*—Henry Bennett
*Assistant Examiner*—Steve Gravini
*Attorney, Agent, or Firm*—Arnold White & Durkee

[57] ABSTRACT

A method of making a dried porous ceramic body having interconnected surface pores and interior channels. The body is formed by extrusion from a paste and is irradiated with microwave radiation to heat it for an initial period at a rate of at least 15° C./minute, after which the irradiation is reduced so that the body is heated at a rate of at most 1° C./minute. Heat loss from the external surface of the body, during heating, is resisted.

10 Claims, 2 Drawing Sheets

METHOD OF DRYING A POROUS BODY

This Invention relates to a method of drying a porous body.

According to one aspect of the invention there is provided a method of drying a porous body having an external surface provided with pores in communication with interconnected pores or channels in its interior containing a liquid, the method comprising the steps of:

subjecting the body to heat energy input by irradiating it with electromagnetic radiation for an initial period to cause the body to undergo an average rate of temperature increase over the initial period of at least 2° C./minute; and reducing the rate of heat energy input or power of the irradiation for a subsequent period to reduce the rate of temperature increase of the body to at most 1 ° C./minute.

The ratio of the initial period: subsequent period may be 1:10–10:1, preferably 1:4–4:1.

According to another aspect of the invention there is provided a method of drying a porous body having an external surface provided with pores in communication with interconnected pores or channels in its interior containing a liquid, the method comprising the steps of:

subjecting the body to heat energy input by irradiating it with electromagnetic radiation to cause the body to undergo an average rate of temperature increase of at least 2° C./minute; and resisting heat energy loss from the external surface of the body.

Preferably the method of the present invention comprises both said step of reducing the rate of heat energy input, and said step of resisting heat energy loss. In this case there may be a ratio between the initial period and the subsequent period of 1:10–10:1, the method including resisting heat energy loss from the external surface of the body.

By drying is meant a reduction in the liquid content of the body to a desired value. Preferably, the drying is carried out to a degree where the body can be handled without causing any damage thereto or unacceptable deformation thereof. For bodies comprising consolidated particulate material of the type described hereunder, a dried body having lost about 2–5% of its wet mass during drying has been found to be sufficiently dry for handling purposes.

Resisting said heat energy loss may be by thermally insulating the body, eg by providing thermal insulation in contact with or in close proximity to the external surface of the body. The heat energy loss may, instead or in addition, be resisted by supplying heat to the external surface of the body from an external heat source, eg by heating walls defining a cavity around the body and/or by maintaining an ambient atmosphere surrounding the body at a predetermined temperature, eg by increasing the temperature of the ambient atmosphere around the body, and/or the temperature of said walls, during said temperature increase of the body. In particular, resisting heat energy loss from the exterior surface of the body may comprise heating the external surface of the body by means of radiant heat, radiated on to the external surface of the body from at least one radiant heat source, such as a radiant heating element. Preferably, the temperature of said walls, and/or the temperature of said ambient atmosphere, are kept as close as feasible or practicable to the temperature of the external surface of the body. In particular, resisting heat energy loss from the external surface of the body may be such as to keep the external surface of the body at substantially the same temperature as the interior of the body, so that no unacceptable temperature gradient exists in the body between any part of its interior which is hotter than the external surface, and the external surface, routine experimentation being employed to determine the reduction of heat loss required. As indicated above, the method may comprise heating the environment surrounding the body to cause its temperature to increase progressively as the temperature of the body increases, the environment being defined by a cavity having a wall or walls directed at the porous body and by the atmosphere in the cavity around the body, and the temperature difference between the external surface of the porous body and the wall surface temperature of the cavity preferably being restricted to an acceptably small value. If desired the surface of the thermally insulating material which faces the body may be heat reflective.

The present invention accordingly has, as a feature thereof, subjecting the body to electromagnetic radiation, to cause the body to undergo a temperature increase, with as small a temperature gradient as feasible or practicable between its interior and its said external surface.

The body will usually be cylindrical or spherical. Typically, the body will comprise a consolidated particulate material, eg a ceramic material, such as α-alumina. Naturally, the body may comprise any other porous material, such as wood. By drying, as contrasted with eg calcining or sintering, is meant that the heating is to a temperature and for a period in an environment such that, if the body comprises inorganic material, the body undergoes no chemical changes to the inorganic material, changes to the body being confined to reversible physical changes related to the reduction of the liquid content thereof. Naturally, if the body comprises organic material, eg wood, certain irreversible chemical changes may occur in the material in addition to the physical reduction of the liquid content thereof.

When the body is formed from consolidated particulate material, the liquid contained in the body will typically be water, the water being present in free and/or bound form in the body. Before drying, the body may have a moisture content of 14–16% by mass, typically 14.5–15.5% by mass. After the drying, due to loss of moisture, the wet mass of the body may have been reduced by at least 2% by mass, typically 4% by mass. Accordingly, the method may include the step of consolidating a particulate material to form the body with a moisture content, before drying, of 14–16% by mass, the drying acting to reduce the moisture content thereof by 2–5% by mass, to a value of 9–14% by mass. More particularly, consolidating the particulate material may be by extrusion, the initial period being measured, for any part of the body, from the moment of extrusion of that part, and the extrusion being into a cavity having a wall or walls spaced at most 100 mm from the body, the temperature of the external surface of the body and the wall surface temperature of the cavity increasing simultaneously and progressively in the direction of extrusion of the body during the initial period, preferably so that any part of the body is opposed to a part of the cavity wall or walls which is at substantially the same temperature. The method may include causing or allowing moisture expelled as vapour from the porous body by the drying to issue from the cavity, so that the pressure in the cavity remains substantially constant during the drying.

In a preferred embodiment, the body is subjected to microwave radiation having a frequency of $0.3\times10^{9}$–$1\times10^{10}$ Hz, usually 1–10 GHz, eg 2.45 GHz being delivered to the body at a power of 2–4 kW/kg, eg 3 kW/kg, of wet body mass. When using microwave radiation, a small temperature profile in the body of the type described above can be promoted by arranging the microwave radiation to provide, in the body, a flux density of microwave radiation, which is as constant as is feasible or practicable.

The initial period may have a value of 0.2–20 minutes, preferably 0.5–5 minutes, eg 1 minute.

In a particular embodiment of the method, the electromagnetic radiation may be microwave radiation having a frequency of of $0.3\times10^{9}$–$1\times10^{10}$ Hz, the initial period having a duration of 0.2–20 minutes and the average rate of temperature increase over the initial period being at least 15° C./minute, the microwave radiation being delivered to the body at a power of 2–4 kW during the initial period and at a power of at most 0.5–2 kW during the subsequent period.

The average rate of temperature increase during the initial period is preferably at least 15° C./minute, eg 30° C./minute.

The maximum temperature to which the body is heated may be at most that temperature, depending on the composition of the body, at which no undesirable effects occur in the body, such as cracking, blistering or the like.

The rate of heat energy input to the body may reduce progressively on a continuous basis or conveniently stepwise, having a high value for the initial period and reducing by eg one or more steps to a lower value or values, for the subsequent period. It should be noted that the rate of temperature increase during the subsequent period can in principle be zero and/or negative, so that there is a temperature plateau and/or a temperature decrease or cooling of the body, during the subsequent period.

As mentioned above, resisting the heat loss from the body may be by providing thermal insulation around the body. Preferably, the insulation is located in close proximity to the external surface of the body. The insulation may be spaced at most 50 cm from the external surface of the body, typically at most 10 cm from the external surface of the body, eg 2 cm from the external surface of the body. Instead of or in addition to the insulation, the heat loss from the body may be resisted by causing the ambient environment or atmosphere surrounding the body to be at the same temperature as the external surface of the body, eg by heating the body in a heated cavity, the cavity having a vapour outlet to allow escape of vapour from liquid evaporated from the interior of the body. In other words, the ambient temperature around the body may be maintained at substantially the same temperature as the external surface of the body, eg by heating the inner wall or walls of a cavity surrounding the body at the same rate as the rate of temperature increase of the body.

Subjecting the body to the electromagnetic or microwave radiation may, as indicated above, be carried out with the body in a microwave cavity. Naturally, the size and shape of the cavity may be selected depending on the size and shape of the body to be dried. As mentioned above, instead of or in addition to having the wall or walls of the cavity heated to correspond in temperature with the body, the wall or walls may be provided with thermal insulation. The thermal insulation may be provided around the body in the cavity, being eg of silica/alumina insulating material. Depending on the degree of thermal insulation and the size of any space around the body between the body and the wall or walls of the cavity, which during heating will be filled with vapour derived from the liquid in the body, it may be possible to dispense with separate heating of the cavity to keep it at the same temperature as the body, the cavity wall or walls being heated by convection and/or conduction from the vapour, and by radiation from the body, so that the temperature difference between the external surface of the body and the cavity wall surface is acceptably small.

The cavity is thus preferably shaped or arranged to fit snugly around the body so that a relatively small space is present between the body and walls defining the cavity, the small space facilitating the maintenance of a high vapour concentration between the cavity and the body, to promote maintenance of the same temperature at the cavity wall surface and at the external surface of the body.

The cavity may be provided with at least one electromagnetic radiation source, such as a microwave source. The microwave source, eg a magnetron, may be adjustable as regards its power output. In a preferred embodiment, there are several such sources, which may be arranged and/or operated to provide a multimode or tuned cavity.

The microwave sources may be arranged and/or spaced from each other in the cavity in which the body is located, in order to promote a constant flux density throughout the body, in turn to promote a constant temperature throughout the body. Routine experimentation will be necessary to determine the optimum microwave intensity, wavelength and positioning of the magnetrons, and the period or periods required for drying, depending on the composition of the body. Microwaves of commercially available wavelength, such as 2.45 GHz, will usually be used.

The reduced rate of temperature increase during the subsequent period may be achieved by subjecting the body to further electromagnetic radiation (eg microwave radiation) at a reduced average heat energy input; or by subjecting the body to any other suitable conventional (radiative, convectional and/or conductive) means of heating. Conveniently, during the subsequent period, the heat energy input is such that the body is maintained at a substantially constant temperature or the body is subjected to a substantially reduced rate of temperature increase, so that its temperature increases slowly, if at all.

The body dried in accordance with the invention may in particular be a ceramic filtration support suitable for use in supporting a filtration membrane in a filter element used for micro- or ultrafiltration applications, such as the supports described in the Applicant's co-pending patent application No. 08/983,080. It will be appreciated, however, that the method in accordance with the invention is not limited to the drying of ceramic filtration supports for filter elements, but extends also in particular to the drying of other extruded or shaped ceramic bodies, such as clay bricks, clay tiles or the like, and indeed also to shaped bodies formed from particulate solids which are not necessarily ceramics. The method may also be applied to non-extruded porous bodies containing liquid, eg bodies comprising elastic porous matrices such as wood, as well as to bodies comprising non-elastic porous matrices such as porous mineral or moulded ceramic bodies.

The invention extends to a process for forming a dried body of porous material which comprises the steps of:

consolidating particulate material containing a liquid to form a porous body having interconnected pores in its interior in which the liquid is contained; and drying the body, the drying being as described above.

The consolidating may be by extrusion or moulding, or by other suitable shaping methods.

Naturally, the particle size and/or particle size distribution of the material forming the body will be selected to provide a body or product of the desired percentage porosity and pore size distribution.

In accordance with the method of the present invention the external surface of the body may be kept as close as possible to the temperature prevailing in its interior, by the employment of one or more of the following optional features:

surrounding the body with thermally insulating material, the insulating material being more or less closely spaced from the external surface of the body;

surrounding the body with an inwardly directed heat reflecting surface, eg on the insulating material;

surrounding the body with heated cavity walls to compensate for radiative heat loss from the external surface of the body; and/or introducing a heated fluid such as heated air to any space surrounding the element to compensate for any heat loss from the external surface of the body arising from convective or conductional heat transfer.

Naturally, two or more, or all, the above features can be employed simultaneously, The invention will now be described, by way of example, with reference to the following worked Example, and with reference to the accompanying diagrammatic drawings, in which.

EXAMPLE

Figure 1:
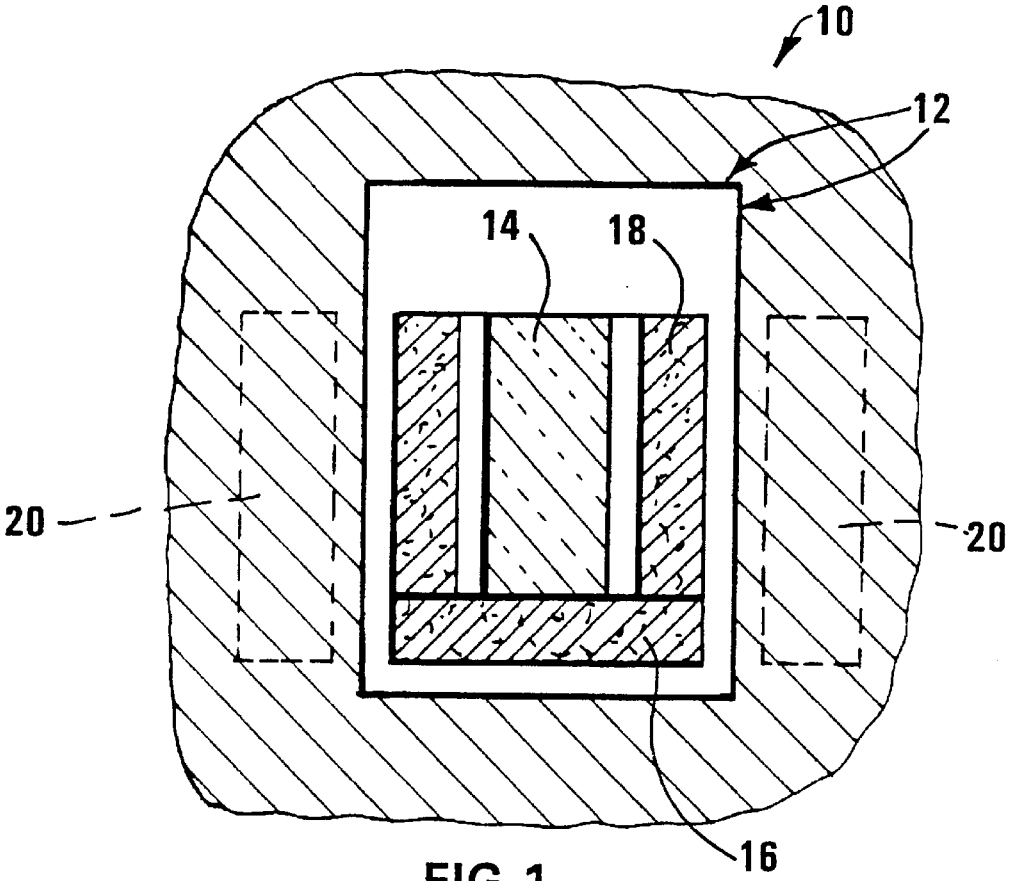
FIG. 1 shows a schematic sectional side elevation of an installation for drying a porous body in accordance with the method of the present invention.

The feasibility of the method of the invention has been demonstrated for the drying of elongated ceramic filter element profiles of the type described in the applicant's co-pending patent application No. 08/983,080. To make such filter elements, a green paste mixture is formulated prior to drying. The exact composition of the green paste mixture is set out in the following Table, Table 1, after which the process of preparation of the green paste is described in detail.

TABLE 1

| % (Wet basis) | Compound | Code | Function |
|---|---|---|---|
| 70.4 | Alcoa Tabular Alumina T-60-325 STD (99% < 45 μm | A | Basic powder |
| 3.7 | Alcoa Reactive Calcined Alumina: A17 NE (90% < 8 μm) | B | Basic powder |
| 5.4 | α-Alumina monohydrate powder (supplied under the name or code KCM GC Powder — obtainable from Keith Ceramics) | C | Plasticizer/sintering aid |
| 2.7 | Methyl cellulose (supplied under the name or code Celocol HPM 15000 DS — obtainable from Courtaulds Chemicals) | D | Plasticizer/binder |
| 2.0 | Sletwyn Kaolin (supplied by Rainbow Industrial Chemicals) | E | Flux material |
| 0.9 | Polyalkylene Glycol (supplied under the name or code Breox 75W — 18000 — obtainable from British Petroleum) | F | Lubricant |
| 14.9 | Water | | |
| Σ100.0 | | | |

The various constituents of the composition in the Table 1 have been given alphabetic codes for ease of explanation of the paste/extrusion body preparation process in the following Example.

A paste/extrusion body was prepared by the cooling of the constituents A, B, C, D, E, and a solution of F in 43% of the total mass of water, to a temperature of 10° C. Constituents A, B, C, D and E were then mixed together in the following sequence of steps. Constituent A was mixed with constituent B for 5 minutes in a ribbon blade mixer. Constituent C was then added to the mixture and mixing was carried out for a further 5 minutes. Constituent D was then added to the mixture and mixing was carried out for a further 5 minutes. Constituent E was then added to the mixture and mixing was carried out for a further 15 minutes. 41 % of the total mass of the water was then added to the mixture and mixing was continued for a further 30 minutes. The moist powder mixture obtained was then stored in a sealed container overnight at a temperature of about 10° C. Constituent F was then added to the moist powder and further mixing was carried out in a high shear mixer for 10 minutes. The resultant paste/extrusion body mixture was then stored and aged in a sealed container at a temperature of 10° C. for 3 days. After addition of the last 16% of the total mass of the water, the aged paste was mixed in a high shear mixer for 90 seconds immediately prior to extrusion thereof.

The die was sized to extrude a profile of circular cross-section of about 98 mm diameter, having a plurality of filtration passages amounting to thirty-six in number, each of 9 mm diameter, which extend the length of the profile, parallel to one another and to the profile. The die also provided the profile with a central drainage passage along its length, coaxial and parallel with the profile and of 9 mm diameter. The passages were arranged in three circular rows, and the rows were equally radially spaced from each other and from the axis and surface of the profile. They formed three concentric circles when seen in end elevation, namely an external circle of eighteen passages and an inner circle of six passages, and an intermediate circle of twelve passages. The profile is intended to form a support for a filter membrane.

In FIG. 1, reference numeral 10 generally designates an installation for carrying out the method of the present invention. In the drawing, reference numeral 12 designates a hollow multimode microwave cavity, within which is located a porous body in the form of the filter element whose formulation and extrusion are described above, the element being designated 14. The element 14 is shown standing upright on one end thereof, on a slab 16 of insulating material. The element 14 is shown further surrounded by a cylinder 18 of the same insulating material, which rests, upright, on the slab 16 concentric with the element 14. The cavity 12 is surrounded by a plurality of circumferentially spaced magnetron microwave radiation applicators 20 arranged to direct microwaves into the cavity 12 at a frequency of 2.5 GHz.

The insulating material comprises a consolidated mixture of 80% by mass particulate $Al_2O_3$ and 20% by mass particulate $SiO_2$. The inner surfaces of the walls, roof and floor of the cavity 12 are coated with a heat reflective material, as are the inner surface of the cylinder 18 and the upper surface of the slab 16.

The slab 16 and cylinder 18 respectively in fact form linings for the floor and side wall of the cavity, and there is a radial spacing of about 9 mm between the element 14 and the cylinder 18. The ratio between the volume of this radial space and the volume of the element 14 (including the volume of its internal filtration passages) is about 1:0.026.

The microwave applicators 20 are tunable as regards their power output, having, in total, a maximum (100%) power output of about 6 kW.

Figure 2:
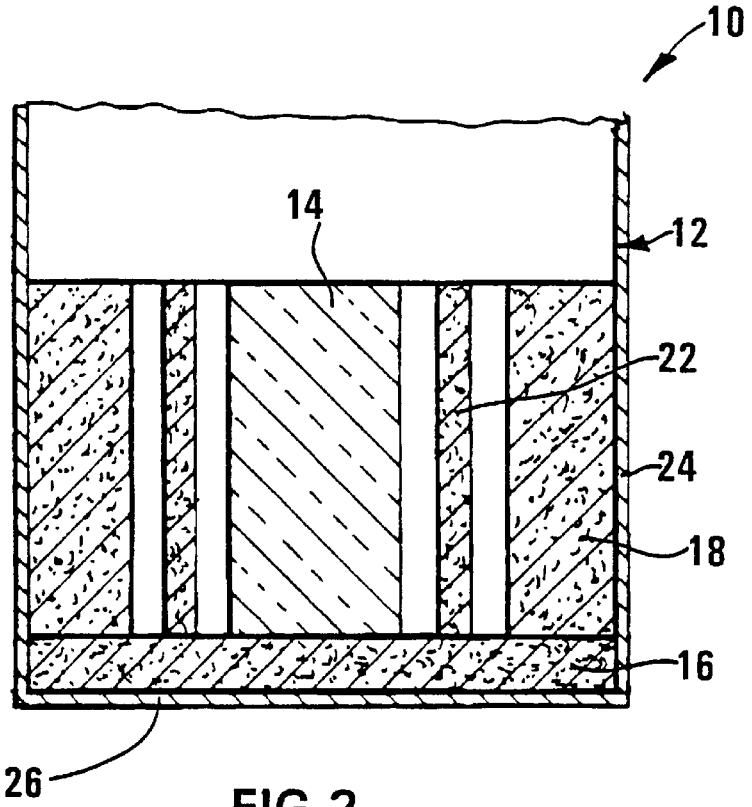
FIG. 2 shows a schematic sectional side elevation of a variation of the installation of FIG. 1.

Turning to FIG. 2, the same reference numerals designate the same parts indicated in FIG. 1, unless otherwise specified. The main difference between the installation 10 in FIG. 1 and that of FIG. 2, is that the installation 10 is shown having an additional inner cylinder 22 of the same insulating material as the cylinder 18 surrounding the element 14. Furthermore, the cavity 12 is defined by metal walls 24 and base 26, the cavity 12 also being surrounded by the radiation applicators (not shown).

Figure 3:
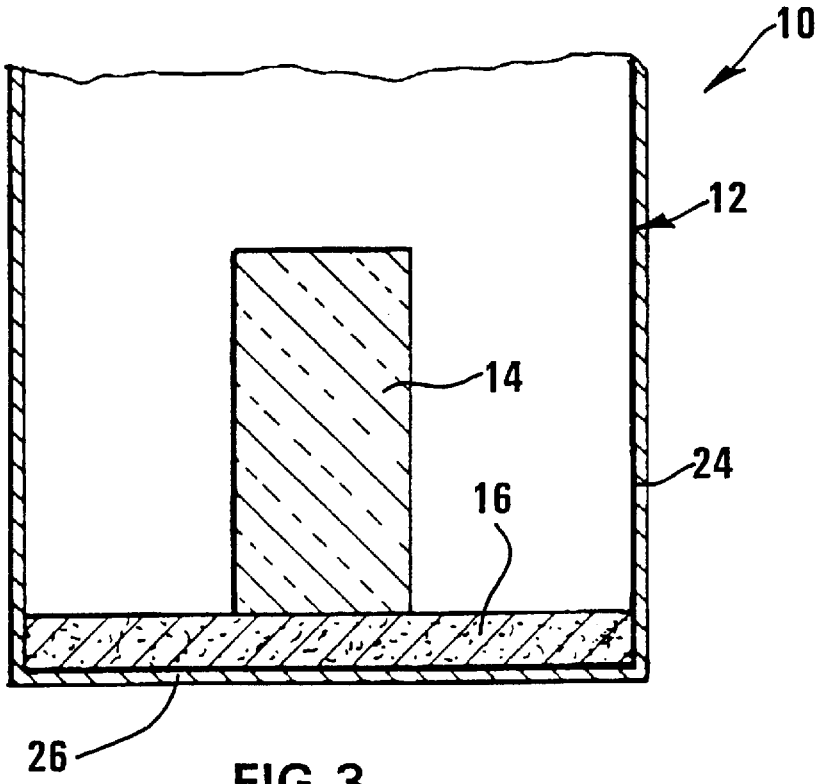
FIG. 3 shows a schematic sectional side elevation of another variation of an installation for drying a porous body in accordance with the method of the present invention.
Figure 4:
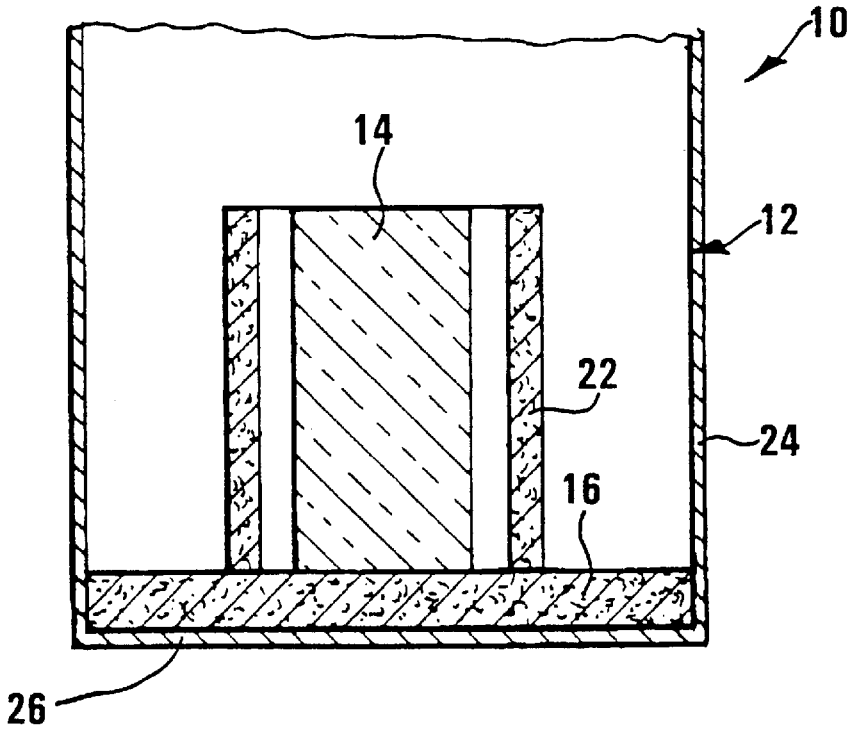
FIG. 4 shows a schematic sectional side elevation of a further variation of the installation of FIG. 3.

Turning to FIGS. 3 and 4, the same reference numerals indicate the same parts as in FIGS. 1 and 2 unless otherwise specified. In FIG. 3, the element 14 is shown standing upright on one end thereof, on the slab 16 of insulating material, with no insulating material surrounding the element 14. The installation 10 of FIG. 4 is similar to that of FIG. 3, except that in FIG. 4 the additional cylinder 22 of insulating material surrounds the element 14.

Two tests, Test 1 and Test 2, were carried out to evaluate the method of the invention, in terms of which two filter elements 14 respectively made as described above were dried in the installation of FIG. 1. Test 1 was in accordance with the invention, and Test 2 was a control, not in accordance with the invention. Shore hardness was measured in accordance with DIN 53 505 (ISO P868) as a percentage, before drying and at various stages during drying.

During the drying the power output of the microwave applicators 20 was varied from time to time, and various temperatures were periodically monitored, inside the channels of the filter elements, at the external walls of the filter elements, and in the interiors of the elements, adjacent their external walls.

The masses of the profiles were also monitored from time to time, to determine the degree of drying. Details are set forth in the following Table, Table 2.

TABLE 2

| Test No | Time (min) | Power % | Mass (g) | Hardness Shore % | $T_w$ (° C.) | $T_c$ (° C.) | $T_s$ (° C.) |
|---|---|---|---|---|---|---|---|
| 1 | 0 (start) | — | 1987.6 | 24 | 24 | 24 | 24 |
| | 1 | 100 | | | | | |
| | 3 | 50 | 1908.5 | 90 | 64 | 90 | 90 |
| 2 | 0 (start) | — | 1955.1 | 24 | 24 | 24 | 24 |

TABLE 2-continued

| Test No | Time (min) | Power % | Mass (g) | Hardness Shore % | $T_w$ (° C.) | $T_c$ (° C.) | $T_s$ (° C.) |
|---|---|---|---|---|---|---|---|
| | 3 | 25 | 1947.35 | 50 | 56 | 67 | 54 |
| | 8 | 25 | 1873.5 | 87 | 87 | 90 | 74 |
| | 28 | 25 | 1663.5 | 99 | 99 | 150 | 78 |

In Table 2, $T_w$ is the external surface temperature of the element in question, $T_c$ is the temperature in a channel thereof, and $T_s$ is the temperature below its surface, adjacent its external surface. For Test 1, values were measured before the start of heating, heating was started at 100% power, with regard to microwave applicator output, and continued for 1 minute, after which it was reduced to 50% power and continued for a further 2 minutes. Heating stopped after 3 minutes, after which various values shown in the Table 2 were again measured. In the case of Test 2, values were measured initially, and respectively after 3 minutes, 8 minutes and 28 minutes, heating taking place at 25% power, with regard to the microwave applicator output.

The Tests showed that Test 1, using a high initial drying power, followed by a low power, resulted after 3 minutes in a stable and substantially dry and hard filter element which could be further processed, eg by calcining and sintering. In case of the control, Test 2, the same results could ultimately be obtained, but a considerably longer drying period was required, longer by about an order of magnitude.

Further tests were carried out to evaluate the method of the invention in terms of which filter elements, respectively made as described above, were dried in the installations of FIGS. 3 and 4. Tests 3 and 4 were in accordance with the invention using the installation of FIG. 3, and tests 5 and 6 were in accordance with the invention using the installation of FIG. 4. The ambient temperature and relative humidity outside the cavity were respectively 21–22° C. and 57–58%. The results of the tests are set forth in the following tables, Table 3 and Table 4 below.

TABLE 3

| Test No | Time (min) | Power % | Mass (g) | Hardness Shore % | $T_w$ wall | $T_c$ channel | $T_s$ solid |
|---|---|---|---|---|---|---|---|
| 3 | 0 | — | 2014.5 | ~24 | | | |
| | 1 | 100 | | | | | |
| | 2 | 50 | | | | | |
| | 3 | 50 | 1921.3 | 85 | | | 91 |
| | | | | 80 | | | |
| | | | | 85 | | | |
| | 6.5 | — | | | | | |
| | 13 | — | | | | | |
| | 21 | — | | | | | |
| | 26 | — | | | | | |
| 4 | 0 | — | 1889.6 | ~24 | | | |
| | 1 | 100 | | | | | |
| | 2 | 50 | | | | | |
| | 3 | 50 | 1785.8 | 85 | | | 92 |
| | | | | 80 | | | |
| | | | | 85 | | | |
| | 6.5 | — | | | | | |
| | 13 | — | | | | | |
| | 21 | — | | | | | |
| | 26 | — | | | | | |

In the case of Tests 3 and 4, heating was started at 100% power, with regard to microwave applicator output, and continued for 1 minute, after which it was reduced to 50% power and continued for a further 2 minutes. Heating stopped after 3 minutes, after which a value shown in Table 3 for Test 3 was again measured. Tests 3 and 4 resulted in blisters forming on the filter element and in Test 3 a cracking sound was heard at the one minute period during heating. For Tests 3 and 4, a moisture loss of 4.63% by mass and 5.49% by mass respectively was recorded.

TABLE 4

| Test No | Time (min) | Power % | Mass (g) | Hardness Shore % | $T_w$ wall | $T_c$ channel | $T_s$ solid |
|---|---|---|---|---|---|---|---|
| 5 | 0 | — | 1890.9 | ~24 | | | |
| | 1 | 100 | | | | | |
| | 2 | 50 | | | | | |
| | 3 | 50 | 1814.6 | 95 | | | 91 |
| | | | | 85 | | | |
| | | | | 95 | | | |
| | 6.5 | — | | | | | |
| | 13 | — | | | | | |
| | 21 | — | | | | | |
| | 26 | — | | | | | |
| 6 | 0 | — | 1890.1 | ~24 | | | |
| | 1 | 100 | | | | | |
| | 2 | 50 | | | | | |
| | 3 | 50 | 1787.5 | 90 | | | 92 |
| | | | | 80 | | | |
| | | | | 90 | | | |
| | 6.5 | — | | | | | |
| | 13 | — | | | | | |
| | 21 | — | | | | | |
| | 26 | — | | | | | |

In the case of Tests 5 and 6, certain values were measured before the start of heating, heating was started at 100% power, with regard to microwave applicator output, and continued for 1 minute, after which it was reduced to 50% power and continued for a further 2 minutes. Heating stopped after 3 minutes. Tests showed that a substantially dry and hard filter element which could be further processed was obtained with no blisters forming on the external surface of the filter element. For Tests 5 and 6, a moisture loss of 4.04% by mass and 5.43% by mass respectively was recorded.

The method of the invention provides a method of drying, suitable for drying green ceramic bodies, which is particularly suitable for the drying of ceramic filter elements in the green state, after extrusion thereof. Short drying times are possible, compatible with extrusion rates of such filter elements, which can be typically extruded at a rate of about 1 cm/s. From this it will be appreciated that slow drying of filter elements as they are continuously extruded, in microwave ovens into which they are extruded, taking up to 30 minutes or more, would result in impractically long drying ovens. The method of the invention, however, allows much shorter drying times and ovens to be used. Furthermore, it is to be noted that, when 100% power was applied for 2.5 minutes, followed by 50% power for 2 minutes and then by 100% power for 1 minute, cracks and blisters were noted on the external surfaces of the elements. This indicates that a power reduction, followed by a power increase, is unsuitable for rapid drying, and suggests that a low initial power followed by a high power may also be unsuitable. Furthermore, blisters were noted in Tests 3 and 4 and confirm the importance of providing insulation around the elements to reduce heat loss from the external surface of the elements during drying thereof.

It is an advantage of the invention that it allows the body to be dried sufficiently to permit handling and further treatment thereof without deformation or damage thereto as a result of mechanical handling of the body and/or gravitational forces acting on the body.

What is claimed is:

1. A method of making a dried porous ceramic body having an external surface provided with pores in communication with interconnected channels in its interior, the method comprising the steps of:

consolidating, by extrusion thereof, a particulate ceramic material in the form of a paste, to form a porous green ceramic body;

drying the body by subjecting, simultaneously with the extrusion thereof, the body to heat energy input by irradiating it with microwave radiation at a frequency of 0.3–10 GHz for an initial period to cause the body to undergo an average rate of temperature increase over the initial period of at least 15° C./minute; and continuing to subject the body, as it is extruded, to said microwave radiation at a frequency of 0.3–10 GHz for a subsequent period, the average rate of temperature increase of the body during the subsequent period being at most 1° C./minute.

2. The method of claim 1, which comprises the step, as the body is extruded, of resisting heat energy loss from the external surface of the body.

3. The method of claim 2, wherein there is a ratio between the duration of the initial period and the duration of the subsequent period of 1:10–10:1.

4. The method of claim 3, wherein said resisting heat energy loss from the external surface of the body comprises heating the external surface of the body by means of radiant heat, radiated on to the external surface of the body from at least one radiant heat source.

5. The method of claim 3, which further comprises heating the environment surrounding the body, as it is extruded, to cause the temperature of the environment to increase progressively as the temperature of the body increases, said environment being defined by a cavity having a wall or walls directed at the porous body and by the atmosphere in the cavity around the body, the body being extruded into the cavity.

6. The method of claim 1, wherein the body is formed with a moisture content, before drying, of 14–16% by mass, the drying acting to reduce the moisture content thereof by 2–5% by mass, to a value of 9–14% by mass.

7. The method of claim 1, wherein the initial period is measured, for any part of the body, from the moment of extrusion of that part, and the extrusion being into a cavity having a wall or walls spaced at most 100 mm from the body, the temperature of the external surface of the body and the wall surface temperature of the cavity increasing simultaneously and progressively in the direction of extrusion of the body during the initial period.

8. The method of claim 5, which includes causing or allowing moisture expelled as vapour from the porous body by the drying to issue from the cavity, so that the pressure in the cavity remains substantially constant during the drying.

9. The method of claim 1, wherein said microwave radiation has a frequency of 1–10 GHz, the initial period having a duration of 0.2–20 min and the microwave radiation being delivered to the body at a power of 2–4 kW during the initial period and at a power of 0.5–2 kW during the subsequent period.

10. A method of drying a porous body having an external surface provided with pores in communication with interconnected channels in its interior containing a liquid, the method comprising the steps of:

drying the body by subjecting it to heat energy input by irradiating it with microwave radiation at a frequency of 0.3–10 GHz for an initial period to cause the body to undergo an average rate of temperature increase over the initial period of at least 15° C./minute; and continuing to subject the body to said microwave radiation at a frequency of 0.3–10 GHz for a subsequent period, the average rate of temperature increase of the body during the subsequent period being at most 1° C./minute.

* * * * *